United States Patent [19]

Anderson, Jr

[11] Patent Number: 4,830,544

[45] Date of Patent: May 16, 1989

[54] TIE-ROD ANCHORING APPARATUS AND METHOD

[76] Inventor: Roy R. Anderson, Jr, 1825 Schilling Rd., Kennesaw, Ga. 30144

[21] Appl. No.: 144,125

[22] Filed: Jan. 15, 1988

[51] Int. Cl.[4] ..... E21D 20/02

[52] U.S. Cl. ..... 405/260; 166/187; 405/262

[58] Field of Search ..... 405/260, 262, 244, 259; 166/187

[56] References Cited

U.S. PATENT DOCUMENTS

| | | | |
|---|---|---|---|
| 3,379,019 | 4/1968 | Williams . | |
| 3,735,541 | 5/1973 | Vanderlinde | 52/98 |
| 3,899,631 | 8/1975 | Clark | 166/187 X |
| 3,981,038 | 9/1976 | Vidal | 14/26 |
| 4,000,623 | 1/1977 | Meardi | 405/260 |
| 4,069,677 | 1/1978 | Yamada . | |
| 4,139,323 | 2/1979 | Brandstetter | 405/260 |
| 4,155,404 | 5/1979 | Hollingsworth | 166/187 X |
| 4,386,876 | 6/1983 | Dupeuble | 405/260 |
| 4,397,589 | 8/1983 | Darroussin et al. | 405/260 |
| 4,413,929 | 11/1983 | Kigawa et al. | 405/260 |
| 4,512,123 | 4/1985 | Fischer | 52/173 |

FOREIGN PATENT DOCUMENTS 1173701 3/1959 France .

*Primary Examiner*—Dennis L. Taylor
*Attorney, Agent, or Firm*—Thomas & Kennedy

[57] ABSTRACT

An apparatus for use in anchoring cables and tie-rods in a hole in the earth with grout comprises a tube having an inlet adjacent one tube end into which grout may be pumped under pressure. The tube has a first outlet from which grout may pass out of the tube and into the earth hole and a second outlet located between the first outlet and inlet. A flexible grout containment sleeve is mounted about the tube second outlet adapted to bellow outwardly when filled with grout under pressure and into sealing engagement with the walls of the earth hole. A pressure relief valve is mounted within the tube for restricting the flow of grout out of the tube first outlet until the sleeve has established sealing engagement with the earth hole walls.

10 Claims, 2 Drawing Sheets

TIE-ROD ANCHORING APPARATUS AND METHOD

TECHNICAL FIELD

This invention relates to apparatuses and methods for use in anchoring cables and tie-rods.

BACKGROUND OF THE INVENTION

Steel cables and tie-rods are commonly anchored in the earth for use in strengthing various structures. These structures typically are retaining walls that are built to shore up embankments, highway lane divider walls, bridges and buildings for occupation. To anchor the end of one or more cables or tie-rods, a hole is first drilled into the earth. One end of the cables or the tie-rods is inserted into the hole which is then filled with grout which upon setting firmly anchors the embedded end of the cables or tie-rods in the earth.

The above description is a simplified explanation of the general procedure employed in anchoring cables and tie-rods. In actuality the grout or cement may not be simply poured into a hole about the cables and allowed to set since the grout will not compactly fill the various cracks, crevices and fissions that extend from the hole sufficiently to establish a sound structure. Also, merely pouring the grout would leave air pockets and holes in the anchor. Therefore, the grout has to be pumped under pressure in order to form a reliable, sound anchor that is firmly embedded.

Pumping grout under pressure into a hole in which cables and tie-rods are placed cannot be done by simply pumping a stream of the grout through a conduit into the hole. This is because the grout will simply flow out of the top of the hole once the hole has been filled without sufficient pressure existing in that portion of the grout that is within the hole. Because of this various apparatuses have heretofore been devised for use in this anchoring procedure.

As exemplified by the devices illustrated in U.S. Pat. Nos. 3,379,019, 3,735,541, 4,139,323 and 4,397,589, some anchor forming devices of the prior art have been designed so as to enable grout to be pumped under pressure, step by step, into a succession of hole spacial sections. Devices of this type have commonly employed an elongated tubular structure with a series of vertical outlets and valve means to enable grout to be pumped first into the bottom of the hole about the end of the tubular device while maintaining a seal about the tube and the walls of the hole. This approach is satisfactory in the sense that cables and tie-rods may be anchored with grout that is formed with sufficient pressure. However, a disadvantage of this aproach is that it takes a substantial amount of time and labor to form the anchor.

Another approach has been to utilize apparatus by which an upper portion of a hole is first grouted without significant pressure and allowed to set to form a seal. Grout is then pumped into the hole through the apparatus beneath the seal established by the upper layer of set grout to establish an embedded anchor in the bottom or end of the hole. Exemplary of apparatus used in this approach is that one shown in U.S. Pat. No. 4,386,876. This approach however is still beset with the same problem, namely the time involved in waiting for the unpressurized grout to set before the embedded anchor is formed.

It thus is seen that a need remains for an apparatus and for a method of anchoring cables, tie-rods and the like in the earth in a more expeditious and efficient manner. It is to the provision of such that the present invention is primarily directed.

SUMMARY OF THE INVENTION

In one form of the invention apparatus for use in anchoring cables and tie-rods in a hole in the earth with grout comprises a tube that has an inlet adjacent one tube end into which grout may be pumped under pressure. The tube has a first outlet from which grout may pass out of the tube and into the earth hole and a second outlet located between the first outlet and the inlet. A flexible grout containment sleeve is mounted about the tube second outlet which is adapted to bellow outwardly from the tube when filled with grout under pressure and into sealing engagement with the walls of the earth hole. The apparatus further comprises pressure relief valve means mounted within the tube for restricting the flow of grout out of the tube first outlet until the sleeve has established sealing engagement with the earth hole walls and thereby caused the pressure of grout within the tube to increase.

Expressed in other terms the apparatus comprises a tube having an inlet into which grout may be pumped under pressure and at least one outlet from which grout may pass out of the tube and into the earth hole about the tube. The tube has an outwardly expandable section adapted to be expanded into sealing engagement with the walls of the earth hole when filled with grout. The apparatus further includes valve means for restricting the flow of grout out of the tube outlet until a threshhold grout pressure level is established within the tube as a result of the tube expandable portion having been expanded into sealing engagement with the walls of the hole.

In yet another form of the invention a method is provided for anchoring a cable or tie-rod in an earth hole. The method comprises the steps of fastening the cable or tie-rod about a tube of a type that has a flexible expandable section, an outlet, and a pressure relief valve located between the expandable section and the outlet. The tube and the cable or tie-rod is inserted into the hole. Grout is then pumped under pressure through the tube and into the tube expandable section thereby causing the expandable section to expand into sealing engagement with the walls of the hole and form a seal. Additional grout is then pumped into the tube under pressure sufficient to cause the pressure relief valve to open and thereby permit grout to exit the tube outlet and to fill the sealed portion of the hole.

DETAILED DESCRIPTION

Figure 1:
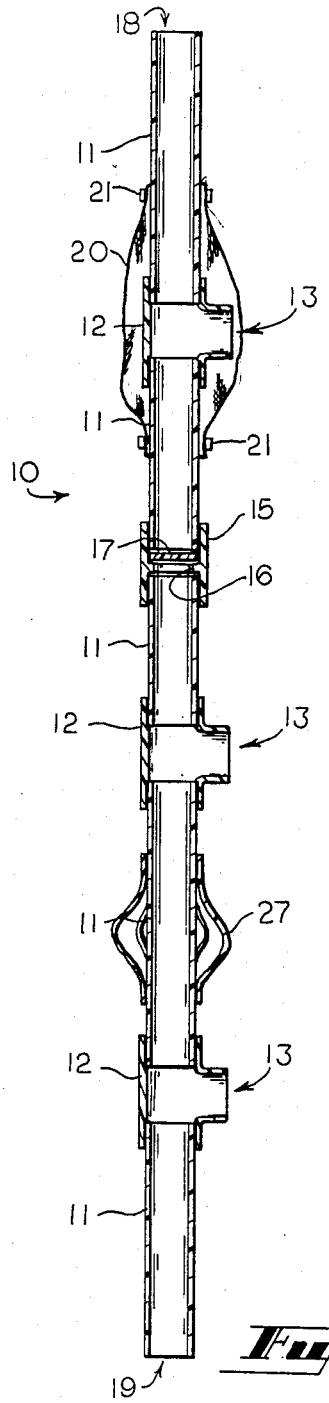
FIG. 1 is a side view, in cross-section, of apparatus embodying principles of the present invention in a preferred form.

With reference next to the drawing, there is shown apparatus 10 for use in anchoring a cable, tie-rod or the like in a hole formed in the earth. It should be understood that the term "earth" here is meant in a general sense as is the term "hole". Such holes may be formed vertically, along inclines or even horizontally. They may be formed in soil, rock or even in preformed structures.

The apparatus is seen to include a tube 11 which is comprised of five distinct sections. These sections are held together by three outlet fittings 13 and one valve fitting 15. The valve fitting 15 has an inwardly projecting annular lip 16 against which a resilient disc or plug 17 is seated to provide a pressure relief valve. The upper end of the tube is open to provide an inlet 18 while the lower end forms an open outlet 19.

Figure 2:
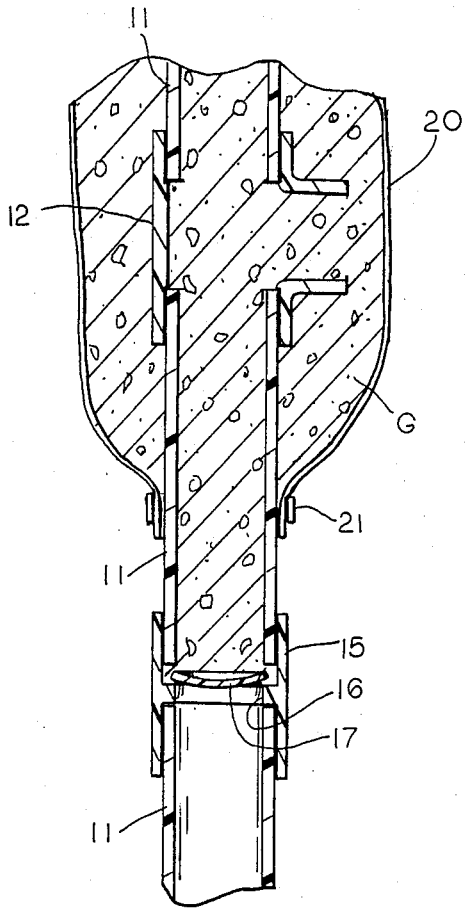
FIG. 2 illustrates a portion of the apparatus shown in FIG. 1 on an enlarged scale.

As best shown in FIG. 2, a flexible sleeve 20 is fastened by two bands 21 about that outlet 13 which is located adjacent inlet 18. This sleeve acts as a filter bag in that it is porous to air and water so as to allow air to permeate the bag and water to seep through it. The sleeve is of a sufficient size to enable it to expand outwardly from the tube 11 a distance sufficient to establish a snug, sealing engagement with the walls of an earth hole into which the apparatus 10 is placed. Thus, the sleeve may herein be considered as providing an expandable portion of the tube. The apparatus also has a conventional hole centering device 27 fitted about the tube. This device has a series of ribs adapted to slideably engage the walls of the hole in maintaining the apparatus centrally within the hole.

For use, a tie-rod or cable 25 is mounted beside the tube 11 so as to pass between the ribs of the centering device 27 as well as through the sleeve 20. Although only one tie-rod is shown here, several may in fact be secured to the tube as an array. The tie-rod is of indefinite length, extending well beyond the anchoring device and out of the hole.

Figure 3C:
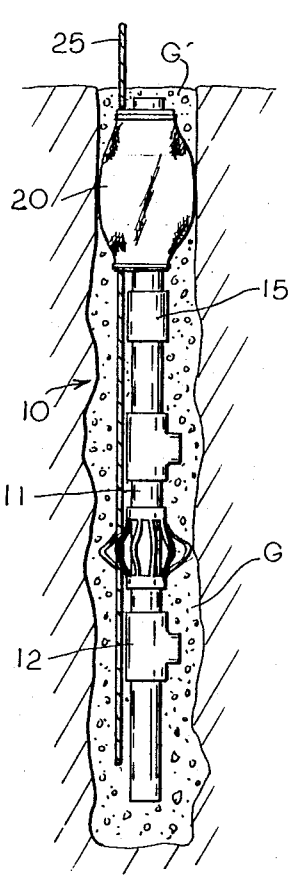
FIGS. 3A–3C illustrate a series of steps taken in practicing the invention by utilizing the apparatus illustrated in FIG. 1.
Figure 3B:
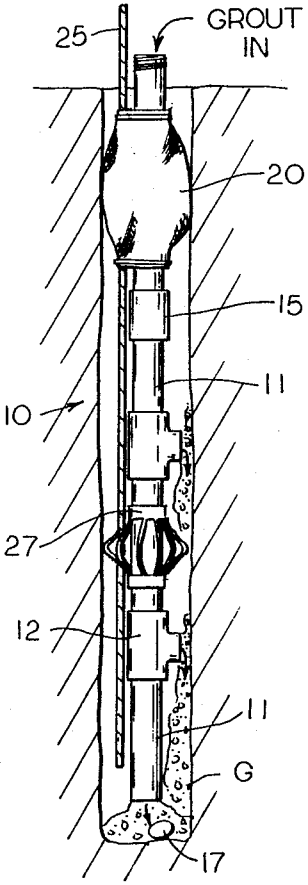
Figure 3A:
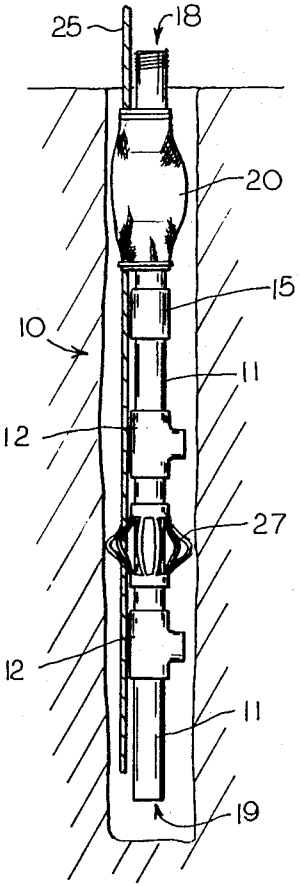

With the end of the tie-rod secured to the apparatus, they are jointly inserted into an earth hole, as shown in FIG. 3. As this is done the centering device 27 engages the side walls of the hole which serves to center the apparatus within the hole. Conventional grout pumping apparatus is next secured to the inlet 18. Grout is then pumped into the apparatus. The grout flows into the inlet 18 and through the tube until it contacts the resilient plug 17 of the valve fitting 15. Continued pumping action forces grout out of outlet 13 and into the flexible sleeve 20. As grout enters and fills the sleeve the sleeve is forced outwardly from its position illustrated in FIG. 3A to its position illustrated in FIG. 3B so as to establish a firm, sealing engagement with an upper portion of the earth hole. Once the sleeve is completely filled, pressure of the grout within the tube increases since the space within the apparatus is now confined by the fully expanded sleeve 20 and the valve plug 17. This forces water in the grout that is in the sleeve 20 out of the sleeve whereupon the grout remaining in the sleeve immediately hardens. The increase in pressure also causes the deformable plug 17 of the valve to bow downwardly, as illustrated in FIG. 2. This bowing action continues until at a threshhold pressure level the deformable plug is forced over the lip 16. When this occurs the plug is fired out of the tube outlet 19 and into the bottom of the earth hole. This action usually is accompanied by a loud pop-like noise. Grout then is pumped down through the remainder of the tube and out of the lower two outlets 13, and the bottom end outlet 19. In this manner the earth hole beneath the seal that has now been established by the flexible sleeve 20 is filled with grout as illustrated in FIG. 3B.

Grout is continued to be pumped until the entire earth hole beneath the seal has been filled as shown in FIG. 3C. Air that had been in the hole is forced into the surrounding ground. The hole filled condition is noted by an increase in pressure of the grouting machine. The pumping operation is ceased and the pump disconnected from the inlet 18. The inlet is then sheared off and the small space above the sleeve 20 filled with a small amount of poured grout. Under some soil conditions the inlet 18 may have to be closed briefly with ancillary valve means until the grout has completely set. Sometimes a grouting operation will be performed a second time. Though the apparatus is normally used to form an anchor for a cable or rod, it could, of course, also be used merely in forming a fill or seal.

It thus is seen that an apparatus and method are provided for use in anchoring cables and tie-rods in earth holes which are of quite simple and labor efficient character. No longer need a series of tedious operations be taken, step by step, to establish a tie-back anchor. Nor must two stage operations be conducted wherein an upper or outer grout space must be formed and allowed to set prior to grouting a lower or inner space. The possibility of blow-out is almost entirely eliminated.

It should be understood that the just described embodiment merely illustrates principles of the invention in a preferred form. Many modifications, deletions and additions may be made thereto without departure from the spirit and scope of the invention as set forth in the following claims.

I claim:

1. Apparatus for use in anchoring cables and tie-rods in a hole in the earth with grout, and with the apparatus comprising a tube having an inlet adjacent one tube end into which grout may be pumped under pressure, a first outlet from which grout may pass out of the tube and into the earth hole, and a second outlet located between said first outlet and said inlet; a flexible grout containment sleeve mounted about said tube second outlet adapted to bellow outwardly from said tube when filled with grout under pressure and into sealing engagement with the walls of the earth hole; and pressure relief valve means mounted within said tube for restricting the flow of grout out of said tube first outlet until said sleeve has established sealing engagement with the earth hole walls and thereby caused the pressure of grout within the tube to increase.

2. The anchoring apparatus of claim 1 wherein said pressure relief valve means is mounted between said first outlet and said second outlet.

3. The anchoring apparatus of claim 1 wherein said pressure relief valve means comprises an annular lip formed on the interior wall of said tube and a deformable plug mounted against said annular lip.

4. The anchoring apparatus of claim 1 wherein said flexible sleeve is sufficiently porous as to permit air and water to pass therethrough.

5. Apparatus for use in anchoring cables and tie-rods in a hole in the earth with grout, and with the apparatus comprising a tube having an inlet into which grout may be pumped under pressure and at least one outlet from which grout may pass out of the tube and into the earth hole about the tube, said tube having an outwardly expandable section adapted to be expanded into sealing engagement with the walls of the earth hole when filled with grout under pressure, and valve means for restricting the flow of grout out of said tube outlet until a threshhold grout pressure level is established within said tube upon said tube expandable portion having expanded into sealing engagement with the walls of the hole.

6. The apparatus of claim 5 wherein said expandable section comprises a flexible sleeve mounted about a rigid tubular section having a second outlet.

7. The apparatus of claim 5 wherein said sleeve is air and water permeable.

8. The apparatus of claim 5 wherein said valve means is mounted between said expandable section and said one outlet.

9. The apparatus of claim 5 wherein said valve means comprises a deformable plug.

10. A method of anchoring a cable or tie-rod in an earth hole comprising the steps of fastening the cable or tie-rod about a tube of a type that has a flexible, expandable section, an outlet and a pressure relief valve located between the expandable section and outlet; inserting the tube and cable or tie-rod into the hole; pumping qrout under pressure through the tube and into the tube expandable section thereby causing the expandable section to expand into sealing engagement with the walls of the hole and form a seal; and pumping additional grout into the tube under pressure sufficient to cause the pressure relief valve to open and thereby permit grout to exit the tube outlet and fill the sealed portion of the hole.

* * * * *